US009990906B2

(12) United States Patent
Tao

(10) Patent No.: US 9,990,906 B2
(45) Date of Patent: Jun. 5, 2018

(54) MUSICAL STRING WITH HIGH MODULUS FIBER WINDING

(71) Applicant: D'Addario & Company, Inc., Farmingdale, NY (US)

(72) Inventor: Fan-Chia Tao, Huntington, NY (US)

(73) Assignee: D'Addario & Company, Inc., Farmingdale, NY (US)

( * ) Notice: Subject to any disclaimer, the term of this patent is extended or adjusted under 35 U.S.C. 154(b) by 229 days.

(21) Appl. No.: 14/597,508

(22) Filed: Jan. 15, 2015

(65) Prior Publication Data

US 2015/0248876 A1 Sep. 3, 2015

Related U.S. Application Data

(60) Provisional application No. 61/946,917, filed on Mar. 3, 2014.

(51) Int. Cl.
*G10D 3/10* (2006.01)

(52) U.S. Cl.
CPC ..... *G10D 3/10* (2013.01)

(58) Field of Classification Search
CPC .. G10D 3/10; D07B 2801/22; D07B 2205/10; D07B 2205/2046; D07B 2201/1036; D07B 2201/2087; G10C 3/08; Y10T 428/2933; Y10T 428/2936; Y10T 428/294; Y10T 428/31544; A63B 51/02
USPC ..... 84/297 R, 297 S
See application file for complete search history.

(56) References Cited

U.S. PATENT DOCUMENTS

| | | | | |
|---|---|---|---|---|
| 3,826,171 | A * | 7/1974 | Kaar | G10D 3/10 84/297 S |
| 4,854,213 | A | 8/1989 | Infeld | |
| 4,993,122 | A * | 2/1991 | Ackeret | D01G 19/16 19/225 |
| 5,578,775 | A * | 11/1996 | Ito | D01F 11/127 428/364 |
| 7,222,481 | B2 * | 5/2007 | Esnault | D02G 3/48 57/210 |
| 2007/0039137 | A1 * | 2/2007 | Dupont | F16G 11/00 24/115 R |
| 2010/0294109 | A1 * | 11/2010 | Rieger | G10D 3/10 84/297 S |
| 2011/0128743 | A1 * | 6/2011 | Matsumi | C09K 19/3809 362/296.01 |
| 2014/0227474 | A1 * | 8/2014 | Cramer | D03D 11/00 428/86 |

FOREIGN PATENT DOCUMENTS

| | | | | |
|---|---|---|---|---|
| JP | 363117188 A * | 5/1988 | | F04C 18/18 |

* cited by examiner

*Primary Examiner* — Kimberly Lockett
(74) *Attorney, Agent, or Firm* — Alix, Yale & Ristas, LLP

(57) ABSTRACT

A string for a musical instrument, comprising a liquid crystal aromatic polyester fiber. Incorporating a synthetic material having a high modulus of elasticity into a musical instrument string substantially increases the torsional stiffness of the string without causing undesirable property changes such as increasing bending stiffness. This is especially useful when used in conjunction with a multifilament synthetic core.

24 Claims, 1 Drawing Sheet

MUSICAL STRING WITH HIGH MODULUS FIBER WINDING

RELATED APPLICATION

This application claims priority under 35 U.S.C. § 119(e) of Provisional Application No. 61/946,917 for Music String With High Modulus Fiber Winding, filed Mar. 3, 2014.

BACKGROUND

The present invention relates to musical instrument strings.

It is well known that musical strings for particular types of instruments, such as a violin, require certain physical properties for proper operation, sound, durability and pitch maintenance. Commonly, instrument strings comprise a central core surrounded by one or more layers of winding. Common core materials include metals such as steel, synthetic fibers like nylon, Kevlar® and gut. Gut core strings exhibit somewhat unique properties not easily emulated by synthetic and metal core strings, and are often considered by musicians as "premium" violin strings.

Synthetic cores often comprise a plurality of individual thin fibers (i.e., multifilament), rather than a single larger central fiber. Achieving the desired properties and performance with a multifilament synthetic core typically requires tight winding of metal, such as for example steel, copper or nickel, over the core. In many known violin strings with a multifilament synthetic core, at least two successive layers of metal winding are needed to achieve the requisite torsional stiffness in the string. Conversely, strings with a gut core typically require only a single metal winding to achieve desired properties, including acceptable torsional stiffness. Many known windings may achieve the objective of improving torsional stiffness, but also carry the drawback of adding substantial bending stiffness to the string.

It would thus be desirable to have a musical instrument string with substantially increased torsional stiffness without a corresponding increase in bending stiffness. It would also be desirable to have a musical instrument string with a non-gut core that emulates the characteristics of a gut core string.

SUMMARY

In one embodiment of the invention, a musical instrument string is provided comprising a liquid crystal aromatic polyester fiber.

In another embodiment, a musical instrument string includes a first liquid crystal polymer fiber winding around a multifilament core. A second winding of metal is provided around the first winding.

In yet another embodiment, a musical instrument string is provided with a winding of a high modulus synthetic fiber around a multifilament synthetic core.

BRIEF DESCRIPTION OF THE DRAWING

The accompanying drawing shows representative embodiments of the inventive musical instrument string according to the disclosure.

DETAILED DESCRIPTION

The inventor has discovered that incorporating a synthetic material having a high modulus of elasticity into a musical instrument string substantially increases the torsional stiffness of the string without causing undesirable property changes such as increasing bending stiffness. This is especially useful when used in conjunction with a multifilament synthetic core.

As used herein "high modulus fiber" means a synthetic, preferably polymeric, fiber possessing high strength and low stretch properties with a modulus of elasticity above approximately 25 GPa (gigapascals). Examples include, without limitation, Kevlar® (polyparaphenylene terephthalamide), Technora® (diaminodiphenylether-para-phenylenediamine-terephthaloyldichloride), Spectra®, Dyneema®, Zylon® (poly(p-phenylene-2,6-benzobisoxazole) fibers, and Vectran® fibers, which have the chemical structure

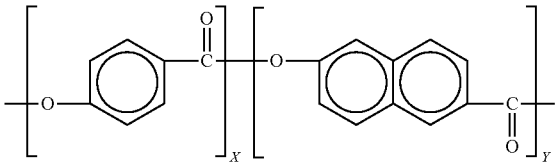

As used herein "LCP" means liquid crystal polymer, a class of aromatic polyester polymers, and may include both para-aramids and meta-aramids, and both thermotropic (crystallinity formed by heating) and lyotropic (crystallinity formed by dissolution in solvent). Representative examples include, without limitation, Kevlar® (lyotropic) and Vectran® (thermotropic) fibers.

As used herein "ultra-high molecular weight polyethylene" means a long chain thermoplastic polyethylene, typically having a molecular weight of approximately 2-6 million. Examples include, without limitation, Dyneema® and Spectra® fibers.

As used herein "liquid crystalline polyoxazole" means an LCP molecule consisting of a chain of oxazole-containing moieties. Examples include, without limitation, Zylon® fiber.

Presently, some musical strings are known to include a high modulus fiber core, but not for windings. No known musical strings incorporate a liquid crystal aromatic polyester fiber, such as an LCP fiber, in any manner—as a winding or core material.

Figure 1:
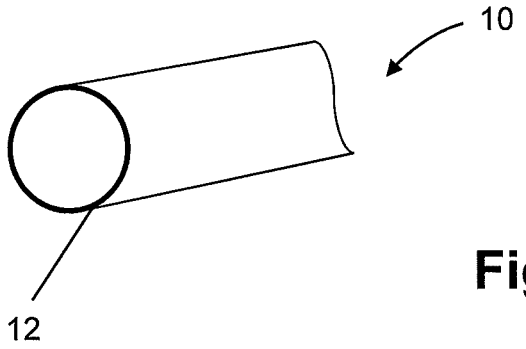
FIG. 1 represents a musical instrument string comprising a liquid crystal aromatic polyester fiber.

FIG. 1 shows a simple, plain string 10 or string component, consisting essentially of a single or multifilament liquid crystal aromatic polymer fiber 12.

Incorporation of a variety of high modulus fibers has been shown to provide significant improvements in the physical properties of musical instrument strings, in particular substantial increase in torsional stiffness without a corresponding increase in bending stiffness. Preferred embodiments of the musical instrument string include at least one high modulus fiber winding around a core, and may include successive windings.

Figure 2:
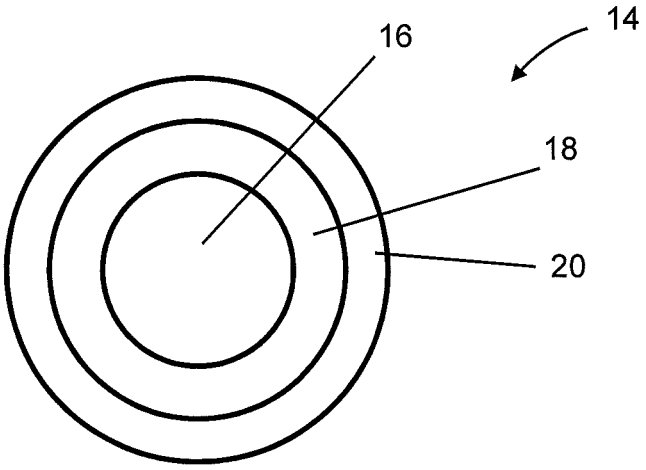
FIG. 2 is a cross section of a string having a multifilament synthetic core, a first winding of a liquid crystal polymer and second winding of metal.

With reference to FIG. 2, a representative embodiment of another disclosed musical instrument string 14 has a multifilament synthetic core 16 with a first winding 18 of a LCP. A second winding 20 of metal is provided over the first LCP winding. In preferred embodiments of the string, the first winding is a thermotropic LCP fiber. More preferably, the LCP first winding comprises a Vectran® fiber with a modulus of approximately 75 GPa. The particular Vectran® fiber employed within the representative embodiment exhibited desirable properties such as relatively high flexibility and low creep (i.e., tendency to deform under mechanical stress). Fibers with a relatively low creep rate provide an advantage of aiding in maintaining torsional stiffness of the core, and thus the string, over time.

Employing a first winding of Vectran® fiber over a multifilament synthetic core in place of the traditional first metal winding, has shown remarkable results in reducing the bending stiffness of the string, while also adding sufficient torsional stiffness. The representative embodiment of the disclosed musical instrument string has demonstrated a feel and quality that users liken to traditional gut core strings with a single metal winding (a style of string that many musicians find to be the most preferable strings on the market). Additional observations of the disclosed musical instrument string include improvement in durability and decrease in the rate of damping.

Aromatic polyesters, such as Vectran® fibers and other fibers with similar properties, have been shown to be particularly effective when incorporated into the disclosed musical instrument strings. The resulting musical instrument string has exhibited exemplary properties, such as significantly increasing torsional stiffness without substantially increasing bending stiffness. However, other LCPs, thermotropic or otherwise, are also suitable for incorporation into the inventive string for this purpose and with similar results.

As discussed above, the LCP winding included in the string of FIG. 2 may be substituted with one or more of a number of high modulus fibers with similar properties. Non-limiting examples of such fibers are identified above.

Further, the construction of the string is not limited in terms of the number of total windings or number of high modulus fiber windings. For example, another embodiment exists with a first LCP winding around a core, followed by two successive metal windings. This embodiment has shown desirable results similar to the embodiment described above and depicted generally in FIG. 2.

Figure 3:
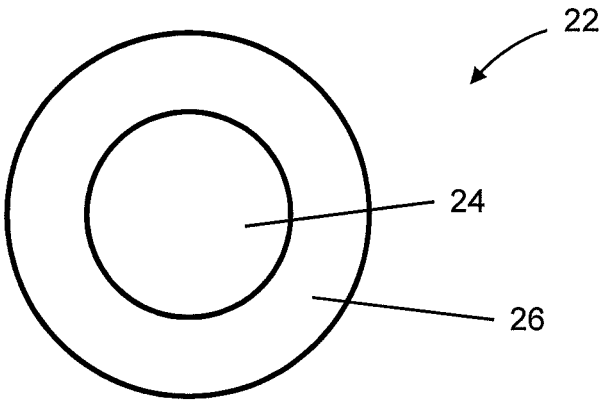
FIG. 3 is a cross section of a musical instrument string with a winding of a high modulus synthetic fiber around a multifilament synthetic core.

FIG. 3 shows another embodiment 22, consisting essentially of a multifilament synthetic core 24 and an immediately conforming high modules synthetic fiber winding 26.

While several embodiments have been set forth for purposes of illustration, the foregoing description should not be deemed a limitation of the invention herein. Accordingly, various modifications, adaptations and alternatives may occur to one skilled in the art without departing from the spirit of the invention and scope of the claimed coverage.

The invention claimed is:

1. A wound string for a musical instrument, comprising a core and a winding wrapped directly around the core to yield a wound musical instrument string, wherein the winding is a liquid crystal aromatic polyester fiber, the wound musical instrument string exhibits increased torsional stiffness relative to the unwound core, and the wound musical instrument string is configured for incorporation into a musical instrument.

2. The string of claim 1, wherein the fiber is a thermotropic form of liquid crystal polymer.

3. The string of claim 1, wherein the polyester fiber has a modulus of elasticity over approximately 50 GPa.

4. The string of claim 3, wherein the polyester fiber has a modulus of elasticity of approximately 75 GPa.

5. The string of claim 1, wherein the polyester fiber has the following molecular structure:

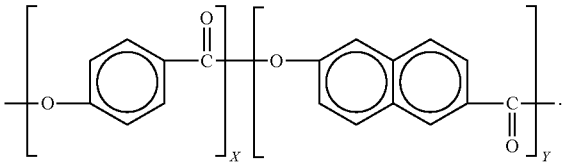

6. A wound string for a musical instrument, comprising:

a multifilament synthetic core;

a first winding wrapped directly around the core; and a second, metal winding around the first winding to yield a wound musical instrument string;

wherein the first winding is a liquid crystal polymer fiber, the wound musical instrument string exhibits increased torsional stiffness relative to the unwound core, and the wound musical instrument string is configured for incorporation into a musical instrument.

7. The string of claim 6, wherein the polymer is an aromatic polyester.

8. The string of claim 7, wherein the polyester fiber is a thermotropic form of liquid crystal polymer.

9. The string of claim 8, wherein the polyester fiber has the following molecular structure:

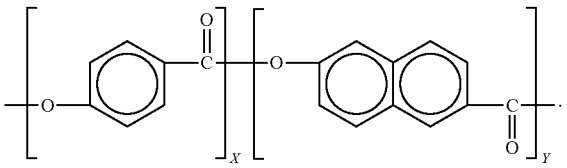

10. The string of claim 6, wherein a plurality of said strings are mounted on a violin.

11. The string of claim 6, comprising a third, metal winding around the second winding.

12. The string of claim 6, wherein the liquid crystal polymer fiber has a modulus of elasticity of above approximately 50 GPa.

13. The string of claim 12, wherein the liquid crystal polymer fiber has a modulus of elasticity of approximately 75 GPa.

14. A wound string for a musical instrument, comprising:

a multifilament synthetic core; and a winding wrapped directly around the core to yield a wound musical instrument string, wherein the winding is a high modulus synthetic fiber, the wound musical instrument string exhibits increased torsional stiffness relative to the unwound core, and the wound musical instrument string is configured for incorporation into a musical instrument.

15. The string of claim 14, wherein the high modulus synthetic fiber is a para-amide.

16. The string of claim 15, wherein the para-amide is selected from the group consisting of polyparaphenylene terephthalamide fiber and diaminodiphenylether-para-phenylenediamine-terephthaloyldichloride fiber.

17. The string of claim 14, wherein the high modulus synthetic fiber is an ultra-high molecular weight polyethylene.

18. The string of claim 17, wherein the ultra-high molecular weight polyethylene is selected from the group consisting of Spectra® fiber and Dyneema® fiber.

19. The string of claim 14, wherein the high modulus synthetic fiber is a liquid crystalline polyoxazole.

20. The string of claim 19, wherein the liquid crystalline polyoxazole is poly(para-phenylene-2,6-benzobisoxazole fiber.

21. The string of claim 14, wherein the high modulus synthetic fiber is a liquid crystal polymer fiber.

22. The string of claim 14, wherein the high modulus synthetic fiber is Dyneema® fiber.

23. The string of claim 14, wherein the high modulus synthetic fiber has a modulus of elasticity greater than 50 GPa.

24. The string of claim 21, wherein the high modulus synthetic fiber has a modulus of elasticity greater than 50 GPa.

* * * * *